US008708552B2

(12) United States Patent
Ueno

(10) Patent No.: US 8,708,552 B2
(45) Date of Patent: Apr. 29, 2014

(54) DAMPING MEMBER, SHOCK DAMPING STRUCTURE IN ELECTRONIC DEVICE, AND ELECTRONIC DEVICE USING THE SHOCK DAMPING STRUCTURE

(75) Inventor: Masato Ueno, Tama (JP)

(73) Assignee: Casio Computer Co., Ltd, Tokyo (JP)

( * ) Notice: Subject to any disclaimer, the term of this patent is extended or adjusted under 35 U.S.C. 154(b) by 710 days.

(21) Appl. No.: 12/912,993

(22) Filed: Oct. 27, 2010

(65) Prior Publication Data

US 2011/0096481 A1 Apr. 28, 2011

(30) Foreign Application Priority Data

Oct. 28, 2009 (JP) ..... 2009-247403

(51) Int. Cl.
*G04B 37/04* (2006.01)

(52) U.S. Cl.
USPC ..... 368/287; 368/286; 368/276; 368/88

(58) Field of Classification Search
USPC ..... 368/286, 287, 300, 276, 277, 288, 289, 368/290; 361/679.34, 679.35, 679.36
See application file for complete search history.

(56) References Cited

U.S. PATENT DOCUMENTS

| | | | | |
|---|---|---|---|---|
| 3,735,584 | A * | 5/1973 | Tokunaga | 368/287 |
| 3,855,786 | A * | 12/1974 | Yamamoto | 368/287 |
| 4,068,464 | A * | 1/1978 | Barnett et al. | 368/69 |
| 4,238,848 | A * | 12/1980 | Yamaguchi et al. | 368/276 |
| 5,442,602 | A * | 8/1995 | Hirai et al. | 368/286 |
| 7,342,743 | B2 * | 3/2008 | Kuwajima | 360/97.19 |
| 7,431,495 | B2 * | 10/2008 | Cretin et al. | 368/287 |
| 7,930,782 | B2 * | 4/2011 | Chen | 5/655.5 |
| 2007/0294916 | A1 * | 12/2007 | Park | 36/29 |

FOREIGN PATENT DOCUMENTS

| | | |
|---|---|---|
| JP | 56-133578 | 10/1981 |
| JP | 58-129189 | 9/1983 |
| JP | 2000046964 | 2/2000 |
| JP | 2003-043166 | 2/2003 |
| JP | 2003-272371 | 9/2003 |

OTHER PUBLICATIONS

Japanese Office Action for Japanese Patent Application No. 2009-247403 mailed on Aug. 5, 2011.

* cited by examiner

*Primary Examiner* — Amy Cohen Johnson
*Assistant Examiner* — Jason Collins
(74) *Attorney, Agent, or Firm* — Amin, Turocy & Watson, LLP

(57) ABSTRACT

A damping member includes a body provided between a device case and a module encased within the case and damping an external shock applied on the case. The body includes a holding member having upper and side surfaces and disposed between an inner peripheral surface of the case and an outer peripheral surface of the module, a first shock absorbing member covering a predetermined part of the upper and side surfaces of the holding member, deformed elastically when the shock is applied on the case, and elastically absorbing the shock, and a second shock absorbing member covering the other part of the holding member, getting the shock earlier than the first shock absorbing member when the shock is applied on the case, each changing its volume in accordance with the shock, and absorbing and escaping the shock. A damping structure used for an electronic device uses the damping member.

7 Claims, 7 Drawing Sheets

DAMPING MEMBER, SHOCK DAMPING STRUCTURE IN ELECTRONIC DEVICE, AND ELECTRONIC DEVICE USING THE SHOCK DAMPING STRUCTURE

CROSS-REFERENCE TO RELATED APPLICATIONS

This application is based upon and claims the benefit of priority from prior Japanese Patent Application No. 2009-247403, filed Oct. 28, 2009, the entire contents of which are incorporated herein by reference.

BACKGROUND OF THE INVENTION

1. Field of the Invention

The present invention relates to a damping member for use in an electronic device such as a wristwatch and a mobile phone to damp an external shock, a shock damping structure in the electronic device, and an electronic device using the shock damping structure.

2. Description of the Related Art

In the past, as disclosed in a Japanese Patent Application KOKAI Publication No. 2000-46964, a wristwatch is known, which includes a shock damping structure configured to dispose a plurality of shock damping members between a wristwatch case and a timepiece module encased within the case and to damp an external shock applied on the case by these shock damping members to protect the timepiece module. In such a case of the shock damping structure of the wristwatch, each of the shock damping members is formed by a material having elasticity such as rubber.

That is, in the plurality of shock damping members, a part of the shock damping members is arranged in a ring shape on a peripheral portion of an upper surface of the timepiece module and damps a shock applied on an upper surface side of the wristwatch case. And, the other part of the shock damping members is arranged flat on a lower surface of the timepiece module so as to damp a shock applied on a lower surface side of the wristwatch case.

In the case of this conventional shock damping structure of the wristwatch, each of the plurality of shock damping members is formed by the material having elasticity such as rubber. Thus, when the case gets external shock, the shock damping members are deformed elastically and damp elastically the shock not to transmit the shock to the timepiece module. Therefore, a range of the shock force absorbed by the plurality of shock damping members is limited in accordance with the elasticity of the shock damping members.

That is, with such a shock damping structure, the shock is damped depending on the elasticity of the shock damping member. Thus, when the shock damping member gets a strong shock which elastically deforms the shock damping member, the shock damping member can damp the shock. But, when the shock damping member gets a weak shock which does not elastically deforms the shock damping member, the shock damping member can not absorb the shock so that the shock is transmitted directly to the timepiece module.

An object of the present invention is to provide a damping member, a shock damping structure for an electric device, and an electric device, capable of securely absorbing any shock, whether it is strong or weak.

BRIEF SUMMARY OF THE INVENTION

In order to achieve the above object, one aspect of the present invention provides a shock damping structure for an electronic device, in which a damping member provided between a device case and a module encased within the device case damps an external shock applied on the device case by a shock absorbing operation of the damping member. The damping member comprises: a holding member having an upper surface portion and an outer peripheral surface portion, and disposed between an inner peripheral surface of the device case and an outer peripheral surface of the module; a first shock absorbing member disposed to cover a predetermined part of the upper and outer peripheral surface portions of the holding member, deformed elastically when the external shock is applied on the device case, and absorbing the shock elastically; and a second shock absorbing member disposed to cover the other part of the upper and outer peripheral surface portions of the holding member, the other part excluding the predetermined part, getting the external shock earlier than the first shock absorbing member when the external shock is applied on the device case, changing its volume in accordance with the shock force, and absorbing and escaping the external shock.

In order to achieve the above object, another aspect of the present invention provides a shock damping structure for an electronic device, in which a damping member provided between a device case and a module encased within the device case damps an external shock applied on the device case by a shock absorbing operation of the damping member. The damping member comprises: a first shock absorbing member disposed between an inner peripheral surface of the device case and an outer peripheral surface of the module, deformed elastically when the external shock is applied on the device case, and absorbing elastically the shock; and a second shock absorbing member disposed at a part between the inner peripheral surface of the device case and the outer peripheral surface of the module, the part excluding the part in which the first shock absorbing member is disposed, getting the external shock earlier than the first shock absorbing member when the external shock is applied on the device case, changing its volume in accordance with the shock force, and absorbing and escaping the external shock.

In order to achieve the above object, further aspect of the present invention provides an electronic device comprising a device case, a module encased within the device case and provided with electronic parts, and a damping member provided between the device case and the module and damping an external shock applied on the device case. The damping member includes: a holding member disposed between an inner peripheral surface of the device case and an outer peripheral surface of the module; a first shock absorbing member disposed at a predetermined position on the holding member, deformed elastically when the external shock is applied on the device case, and elastically absorbing the shock; and a second shock absorbing member disposed side by side with the first shock absorbing member on the holding member, getting the external shock earlier than the first shock absorbing member when the external shock is applied on the device case, changing its volume in accordance with the shock force, and absorbing and escaping the external shock.

In order to achieve the above object, more further aspect of the present invention provides a damping member comprising a damping member body provided between a device case and a module encased within the device case and damping an external shock applied on the device case. The damping member body includes: a holding member having an upper surface and a side surface and disposed between an inner peripheral surface of the device case and an outer peripheral surface of the module; a first shock absorbing member disposed to cover a predetermined part of the upper and side surfaces of the holding member, deformed elastically when the external shock is applied on the device case, and elastically absorbing the external shock; and a second shock absorbing member disposed to cover the other part of the holding member, the other part excluding the predetermined part, getting the external shock earlier than the first shock absorbing member when the external shock is applied on the device case, changing its volume in accordance with the shock force, and absorbing and escaping the external shock.

In the various aspects of the invention, when the device case externally gets a weak external shock which does not elastically deform the first shock absorbing member, the second shock absorbing member changes its volume in accordance with the shock force to absorb and escape the shock force. When the device case gets a strong external shock which elastically deforms the first shock absorbing member, at first the second shock absorbing member changes its volume to absorb and escape a part of the strong shock, and then the remainder of the strong shock which have not been absorbed by the second shock absorbing member is absorbed by an elastic deformation of the first shock absorbing member. Therefore, even when the device case gets any external shock whether it is strong or weak, the shock is securely absorbed so that a module within the device case and electronic parts in the module are securely protected well.

Additional objects and advantages of the invention will be set force in the description which follows, and in part will be obvious from the description, or may be learned by practice of the invention. The objects and advantages of the invention may be realized and obtained by means of the instrumentalities and combinations particularly point out hereinafter.

BRIEF DESCRIPTION OF THE SEVERAL VIEWS OF THE DRAWINGS

The accompanying drawings, which are incorporated in and constitute a part of the specification, illustrate an embodiment of the present invention, and together with the general description given above and the detailed description of the embodiment given below, serve to explain the principles of the present invention.

DETAILED DESCRIPTION OF THE INVENTION

Figure 1:
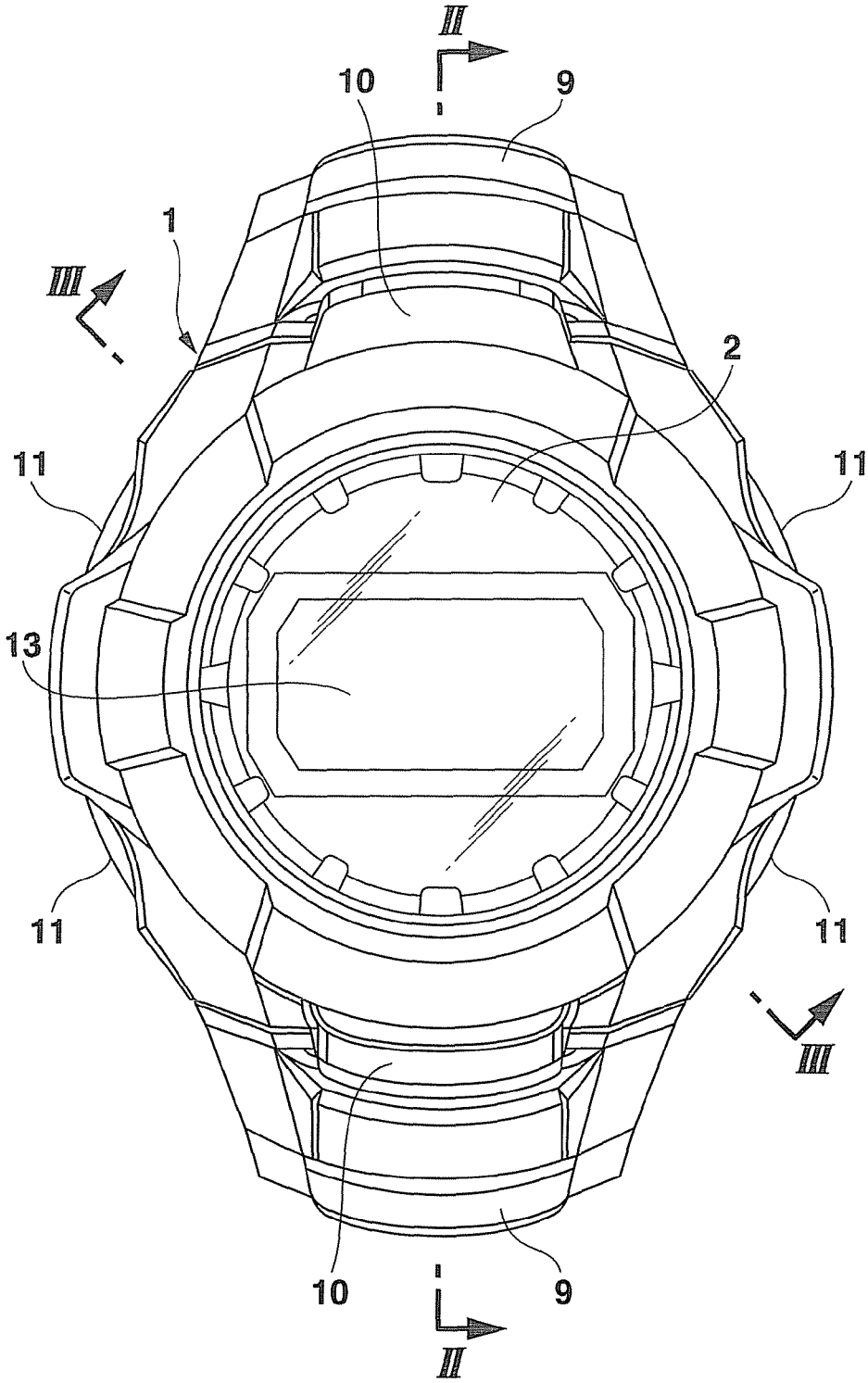
FIG. 1 is a front view of an embodiment of a wristwatch according to the present invention.
Figure 2:
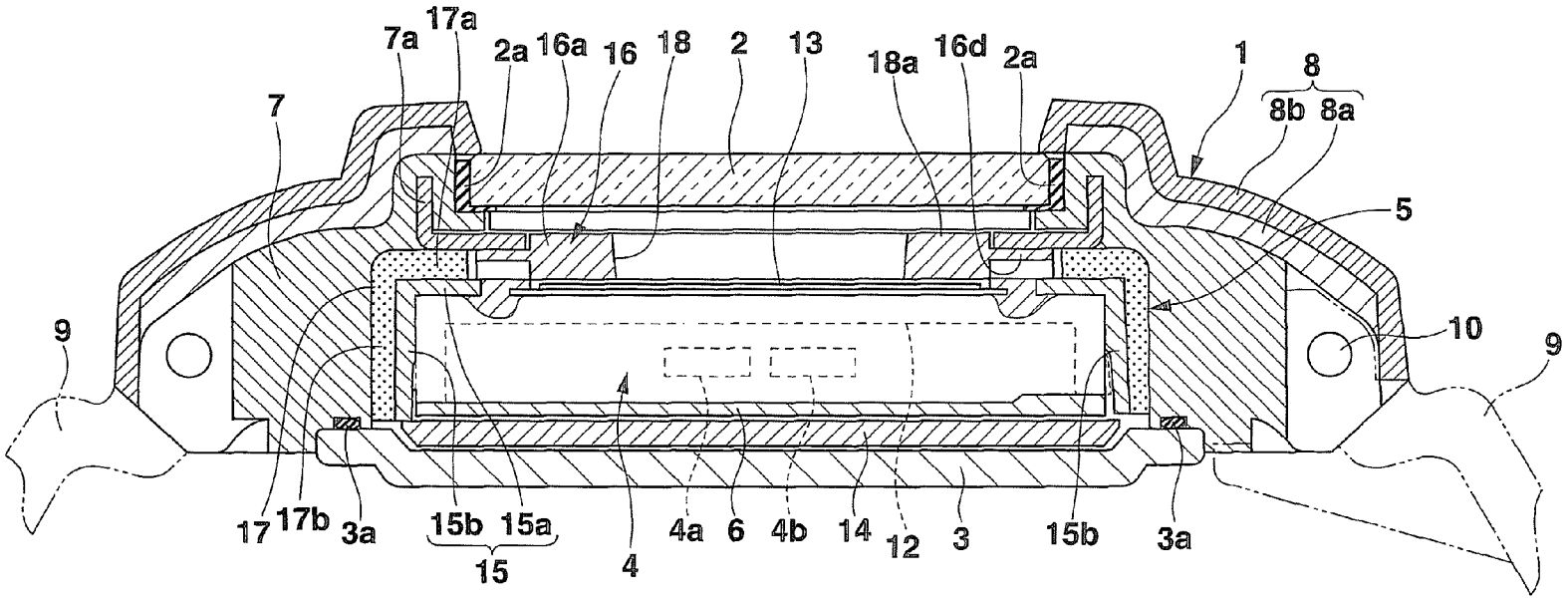
FIG. 2 is an enlarged cross-sectional view taken along a line II-II in FIG. 1.
Figure 3:
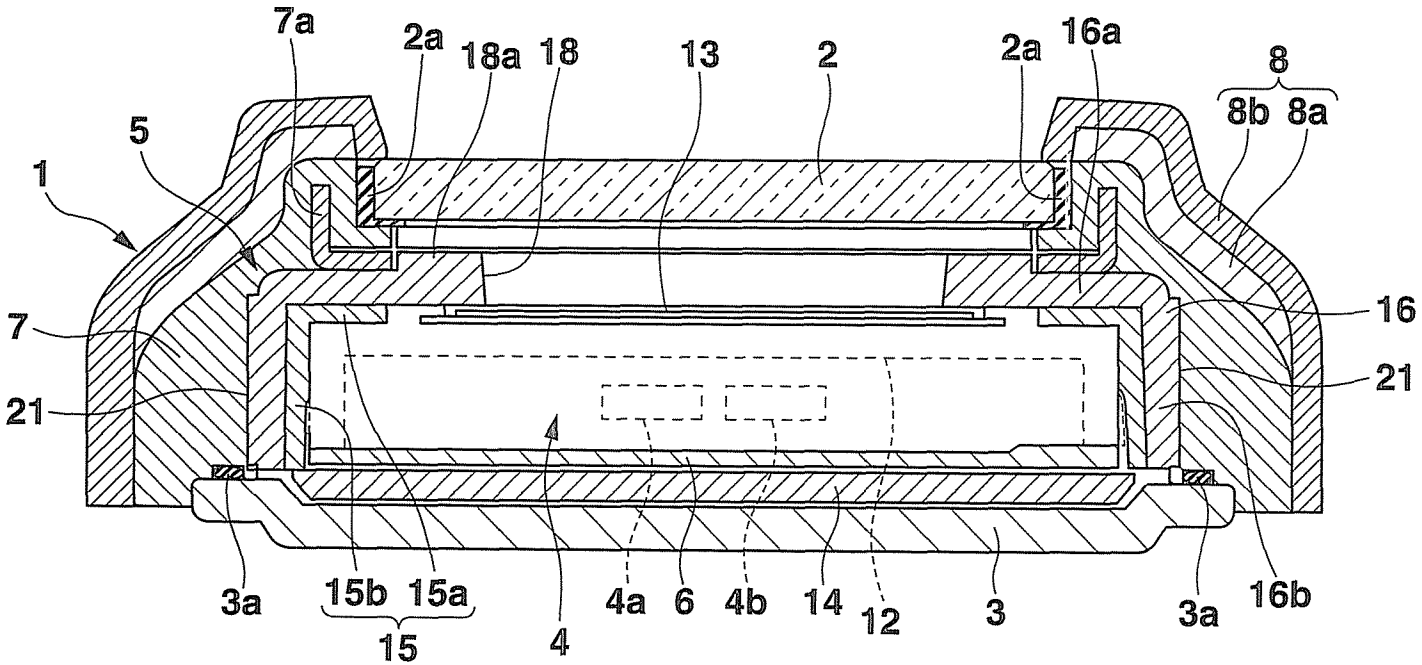
FIG. 3 is an enlarged cross-sectional view taken along a line III-III in FIG. 1.

Referring to FIGS. 1-7C, one embodiment of a wristwatch according to the present invention will be described. As shown in FIGS. 1-3, the wristwatch comprises a wristwatch case 1. A watch glass 2 is attached to an upper opening portion of the wristwatch case 1 with a packing 2*a*, and a rear cover 3 is attached to a lower portion of the wristwatch case 1 with a waterproof ring 3*a*. Within the wristwatch case 1, a timepiece module 4 is encased with a shock damping member 5 and a cushion material 6. The cushion 6 is made of an elastic material such as rubber, and supported on the rear cover 3 by a support plate 14.

As shown in FIGS. 2 and 3, the wristwatch case 1 comprises a case body 7 made of a rigid synthetic resin and a bezel 8 which is a two-layered structure and which is disposed on an outer peripheral surface of the case body 7. In the upper portion of the case body 7, a circular tray-shaped reinforcing member 7*a* of metal with a large opening in its bottom surface is embedded by an insert molding. The bezel 8 is structured by a lower bezel 8*a* made of a soft synthetic resin and provided on the outer peripheral surface of the case body 7 and an upper bezel 8*b* made of a synthetic resin somewhat harder than the lower bezel portion 8*a* and is disposed on an outer surface of the lower bezel 8*a*.

As shown in FIGS. 1 and 2, a band attaching portion 10 to which a watch band 9 is attached is provided on each of 12 and 6 o'clock positions on the wristwatch case 1. Two push button switches 11 are provided at each of 3 and 9 o'clock positions on the wristwatch case 1.

As shown in FIGS. 2 and 3, an outer periphery of the timepiece module 4 is covered with a housing 12 made of a rigid synthetic resin. A display panel 13 which displays information such as time electro-optically, is provided on an upper portion of the housing 12. The display panel 13 is structured by a flat type display element such as a liquid crystal display element or an EL (electroluminescent) display element.

Figure 5:
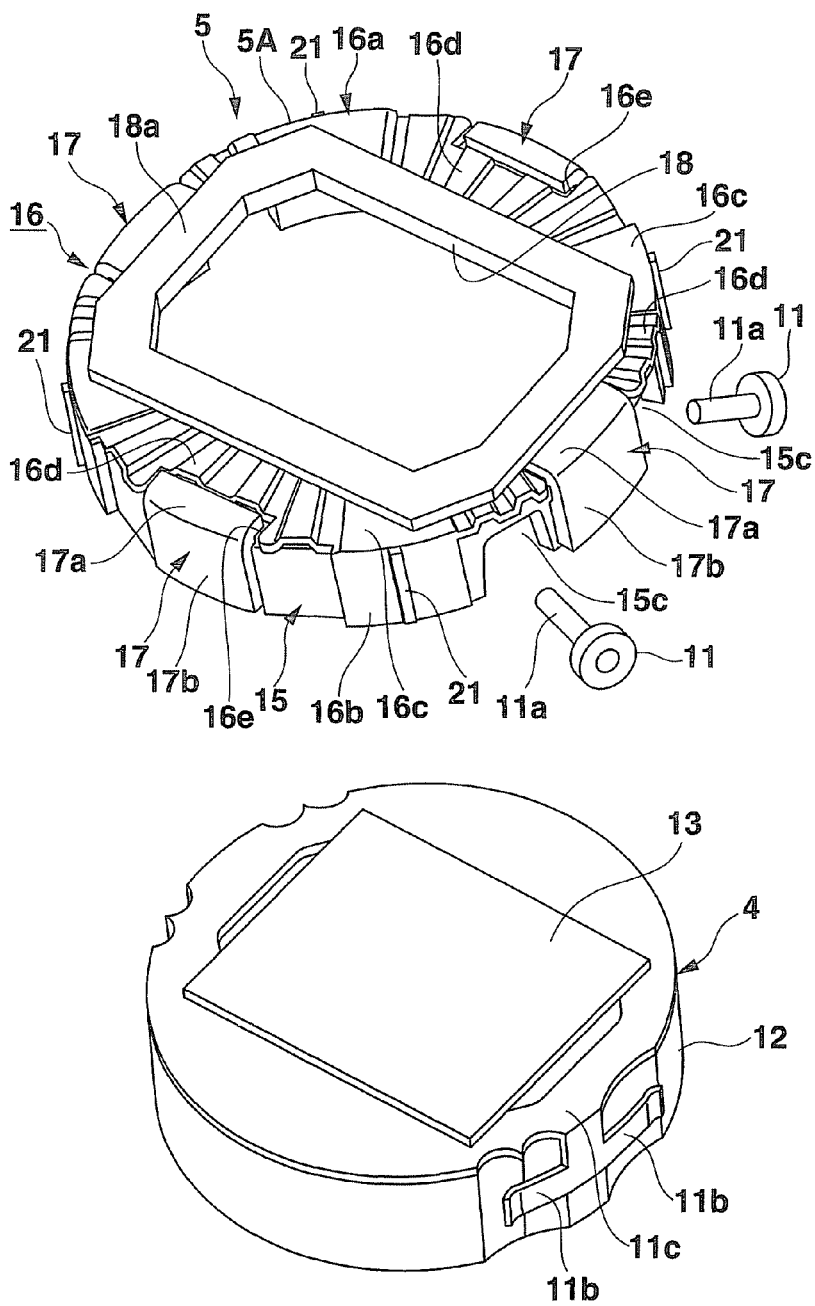
FIG. 5 is an exploded perspective view of the timepiece module and the damping members.

An electronic circuit portion 4*a* for driving the display panel 13 and various electronic parts 4*b* necessary for performing a timepiece function are installed in an inner portion of the housing 12. Further, as shown in FIG. 5, a terminal member 11*c* is provided on an upper surface of the housing 12. The terminal member 11*c* includes two conductive terminal plates 11*b* extending horizontally in opposite directions on the outer periphery of the housing 12, and the conductive terminal plates 11*b* are pressed and operated by the two press button switches 11 as described later.

As shown in FIGS. 2 and 3, the timepiece module 4 is encased within the wristwatch case 1 with the shock damping member 5 covering the outer peripheral surface of the housing 12 covering the outer periphery of the timepiece module 4.

As shown in FIGS. 2-6, the damping member 5 comprises a holding member 15 which includes a ring-shaped upper surface portion 15*a* arranged on the housing 12 coaxially thereto within the wristwatch case 1 and a cylindrical portion 15*b* covering the housing 12 located under the upper portion 15*a*, a first shock absorbing member 16 which includes a ring-shaped upper surface portion 16*a* arranged on the ring-shaped upper surface portion 15*a* of the holding member 15 coaxially thereto and side leg portions 16*b* hanging down on the outer peripheral surface of the holding member 15 from 1, 5, 7, and 11 o'clock positions along an outer periphery of the ring-shaped upper surface portion 16*a* respectively, and a second shock absorbing member 17 which includes side leg portions 17*b* arranged between the hanging down side leg portions 16*b* of the first shock absorbing member 16 on the outer periphery of the holding member 15. The holding member 15 as a whole receives an external shock applied on the wristwatch case 1 and relief a concentration of the external shock on one part of the timepiece module 4. The first shock absorbing member 16 is made of elastic material such as rubber or elastomer and elastically deformed by the external shock applied on the wristwatch case 1. The second shock absorbing member 17 is elastically deformed by the external shock applied on the wristwatch case earlier than the first shock absorbing member 16 and absorbs and escapes the external shock.

The holding member 15 is made of a rigid synthetic resin, for example, polyacetal (POM), or a metal. The holding member 15 has a positioning function which prevents the timepiece module 4 from rotating horizontally within the wristwatch case 1 and positions the timepiece module 4 relative to the wristwatch case 1. To perform this function, an inner surface of the holding member 15 is provided with a protrusion or a recess (not shown) for positioning the holding member 15 at a predetermined position of the wristwatch case 1.

Figure 4:
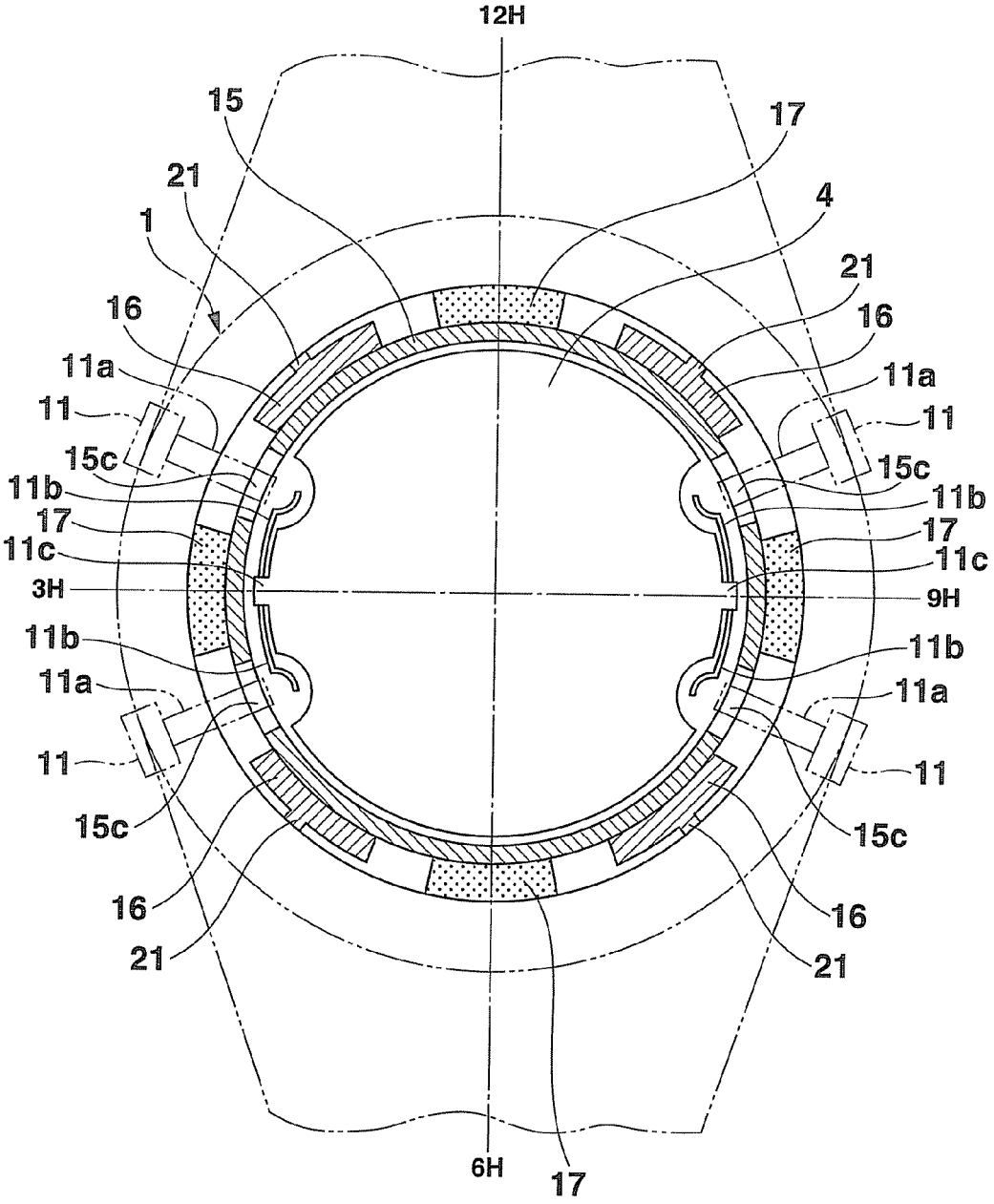
FIG. 4 is an enlarged bottom view of a timepiece module and damping members of the wristwatch of FIG. 2.
Figure 6:
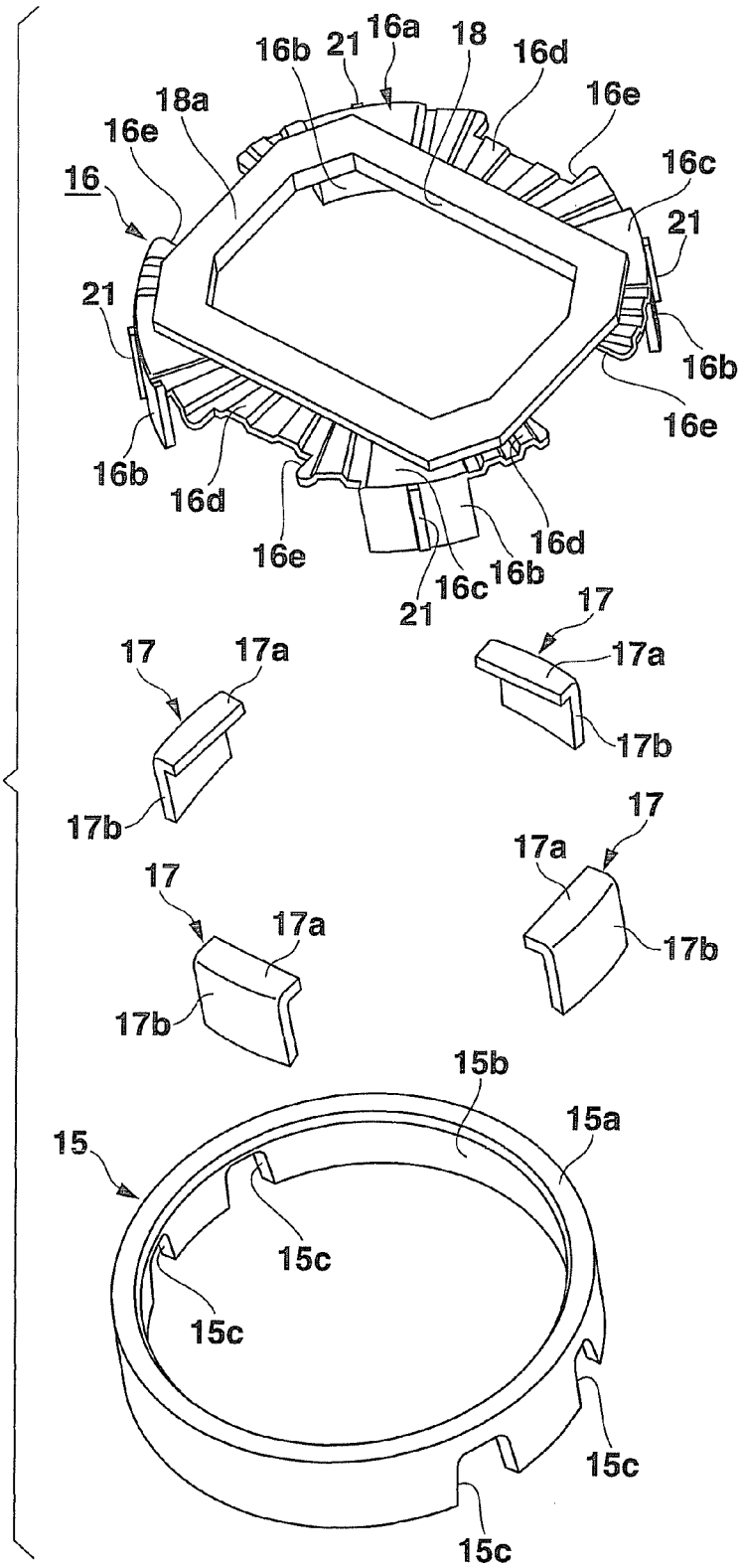
FIG. 6 is an exploded perspective view of the damping members of FIG. 5.

As shown in FIGS. 4-6, an axial portion 11*a* of the push button switch 11 is inserted in each of a pair of cut-out portions 15*c* provided at each of 3 and 9 o'clock sides on the cylindrical outer peripheral surface portion 15*b* of the holding member 15 to enable the axial portion 11*a* to push the conductive terminal plate 11.

As shown in FIGS. 2 and 3, a rectangular opening portion 18 for display is formed in a center portion of the upper surface portion 16*a* to correspond to a display area of the display panel 13 located under the rectangular opening portion 18. A substantially rectangular frame-like delimiting portion 18*a* is formed on outer peripheral portion of the opening portion 18 for display and presses a peripheral edge on an upper surface of the display panel 13. The upper surface portion 16*a* excepting the delimiting portion 18*a* of the opening portion 18 for display is disposed between the reinforcing member 7*a* provided in the case body 7 of the wristwatch case 1 and the ring-shaped upper surface portion 15*a* of the holding member 15, and configured to be in elastically contact with them.

As shown in FIGS. 2, 3, 5 and 6, the upper surface portion 16*a* of the first shock absorbing member 16 includes a plurality of bending portions 16*c* extending radially inward of the upper surface portion 16*a* from the upper ends of the side leg portions 16*b* of the first shock absorbing member 16 and a plurality of auxiliary damping portions 16*d* arranged (at 12, 3, 6 and 9 o'clock positions on the upper surface portion 16*a*) between the bending portions 16*c* of the first shock absorbing member 16.

Each auxiliary damping portion 16*d* includes a corrugated portion having alternately arranged and radially extending rectangular mountains and valleys and connecting the bending portions 16*c* extending radially inward of the first shock absorbing member 16 with each other. The thickness of each auxiliary damping portion 16*d* is thinner than that of each bending portion 16*c*, and the whole thickness (a height difference between a top and a bottom in the corrugation) substantially equal to the thickness of the second shock absorbing member 17. The auxiliary damping portion 16*c* is configured to be elastically deformed to crush the corrugated portion when the auxiliary damping portion 16*c* is pressed by the reinforcing member 7*a*.

As shown in FIGS. 5 and 6, the side leg portions 16*b* of the first shock absorbing member 16 are provided at the 1, 5, 7 and 11 o'clock positions as the predetermined positions on the outer peripheral surface of the cylindrical portion 15*b* of the holding member 15. An auxiliary damping protruding portion 21 a width of which in an circumferential direction is narrow is provided at a center portion of an outer surface of each side leg portion 16*b* along up and down directions. As shown in FIG. 3, the auxiliary damping protruding portion 21 is configured to make a projecting end surface thereof normally contact an inner peripheral surface of the wristwatch case 1 so that the outer peripheral surface of the side leg portion 16*b* is kept away from the inner peripheral surface of the wristwatch case 1.

That is, the auxiliary damping protruding portion 21 is formed to have a height which is substantially the same as that of an outer surface of a second shock absorbing member 17 described more in detail later. The side leg portion 16*b* of the first shock absorbing member 16 is configured to be elastically deformed together with the auxiliary damping protruding portion 21 when the auxiliary damping protruding portion 21 is pushed by the inner peripheral surface of the wristwatch case 1, so that the side leg portion 16*b* elastically contacts the inner peripheral surface of the wristwatch case 1.

As shown in FIGS. 4-6, the side leg portions 17*b* of the second shock absorbing members 17 are arranged at 12, 3, 6 and 9 o'clock positions on the holding member 15 excluding the positions on which the side leg portions 16*b* of the first shock absorbing member 16.

That is, each of the second shock absorbing member 17 includes a radially inwardly extending bending portion 17*a* arranged on an upper surface of the ring-shaped upper surface portion 15*a* of the holding member 15 to correspond to each of the cut-out portions 16*e* provided on the outer periphery of the upper surface portion 16*a* of the first shock absorbing member 16, and a side leg portion 17*b* arranged on the outer surface of the cylindrical portion 15*b* of the holding member 15 at a position at which the side leg portion 16*b* of the first shock absorbing member 17 is not arranged, and each bending portion 17*a* is integrally formed with each side leg portion 17*b*.

The second shock absorbing member 17 is made of a shock damping material formed by blending filler into, for example a silicone gel which is a gel-like material whose main component is silicone.

The filler includes, for example, hollow micro bodies of 1-3 weight parts, each hollow micro body having an outer shell of a synthetic resin, and silica of 10-30 weight parts while the silicone gel has 100 weight parts. And, a hardness of the gel-like material is 15-60 in an Asker C hardness, a thickness thereof is, for example 0.5-2.0 mm, and a shock damping rate thereof is 70% or more.

That is, the second shock absorbing member 17 is configured to be deformed with a change in its volume when the second shock absorbing member 17 gets an external shock force, and to escape the shock, thereby absorbing the external shock. In this case, a thickness of the upper piece 17*a* of the second shock absorbing member 17 is formed to be equal to or to be more thicker than the whole thickness of the wave shaped auxiliary damping portion 16*d* provided on the upper surface portion 16*a* of the first shock absorbing member 16. Further, as shown in FIG. 4, the second shock absorbing member 17 is formed to have a large whole thickness so that the outer surface of the side leg portion 17*b* projects equal to or slightly larger than the projecting end surface of the auxiliary damping protruding portion 21 provided on the side leg portion 16*b* of the first shock absorbing member 16.

As a result of this, each of the second shock absorbing members 17 is configured to get a shock earlier than the first shock absorbing member 16 when the shock is externally applied to the wristwatch case 1. Therefore, when the shock is externally applied to the wristwatch case 1, a part of the shock is absorbed by the second shock absorbing members 17, and then the remainder part of the shock which has not been absorbed by the second shock absorbing members 17 is applied to the first shock absorbing member 16.

Figure 7A:
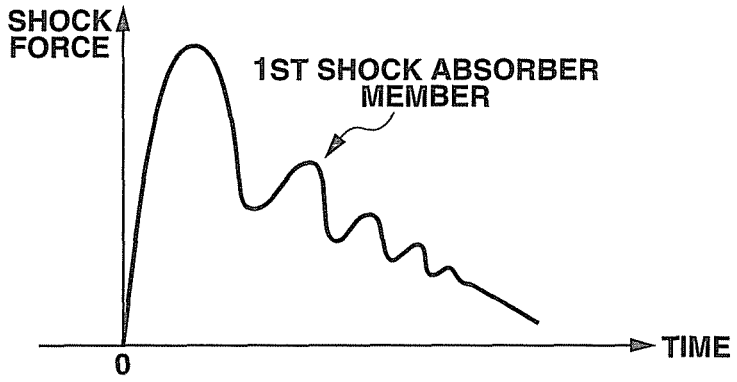
FIG. 7A illustrates a shock damping characteristic of a first shock absorbing member.
Figure 7B:
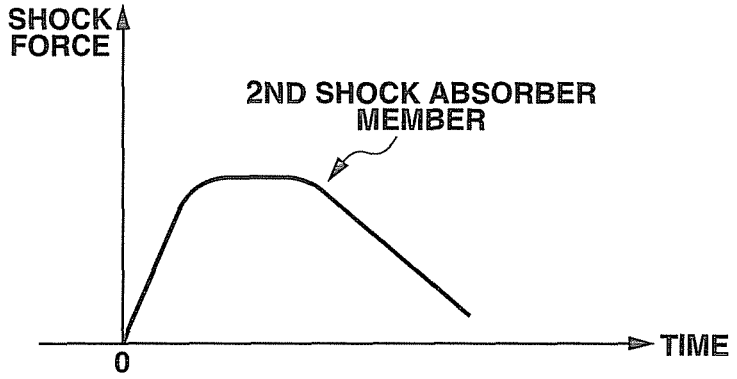
FIG. 7B illustrates a shock damping characteristic of a second shock absorbing member.

That is, when a weak shock which does not cause the first shock absorbing member 16 to be elastically deformed is externally applied on the wristwatch case 1, the second shock absorbing member 17 changes in its volume in response to the weak shock force to escape the weak shock in a surface direction of the second shock absorbing member 17 and absorbs the weak shock. In this case, as shown in FIG. 7B, the second shock absorbing member 17 is configured to change its volume rapidly and to maintain a maximum volume state after it is changed for some time, and then returns to its original state without causing a damping vibration.

The first shock absorbing member 16 is so configured that, when a strong external shock which deforms the first shock absorbing member 16 elastically is applied on the wristwatch case 1, at first a part of the shock is absorbed by the second shock absorbing members 17, and then the remainder of the shock which has not been absorbed by the second shock absorbing members 17 is elastically absorbed by the elastic deformation of the first shock absorbing member 16. In this case, as shown in FIG. 7A, the first shock absorbing member 16 is so configured that, when the first shock absorbing member 16 alone gets a shock, the first shock absorbing member 16 rapidly and elastically deforms, and then gradually returns to its original state while causing the damping vibration.

Figure 7C:
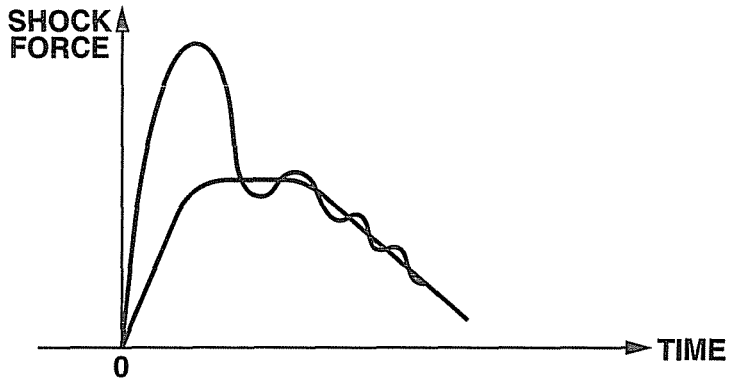
FIG. 7C illustrates a shock damping characteristic obtained by combining the first and second shock absorbing members with each other.

Therefore, in a case that the first and second shock absorbing members 16 and 17 are combined and used, while the first shock absorbing member 16 together with the second shock absorbing members 17 are elastically deformed by getting a shock force and damp it, as shown in FIG. 7C, the damping vibration of the first shock absorbing member 16 is suppressed by the second shock absorbing members 17 during the first shock absorbing member 16 damps the shock force, and the first shock absorbing member 16 returns to its original state with its damping vibration being relieved during the first shock absorbing member 16 performs its damping vibration.

As described above, with this shock damping structure of the wristwatch, when an external shock is applied to the wristwatch case 1, at first a part of the shock is absorbed by the shock absorbing operation of the second shock absorbing members 17 and the remainder of the shock which has not been absorbed by the second shock absorbing members 17 is elastically absorbed by the elastic deformation of the first shock absorbing member 16. Thus, whether the shock is strong or weak, it is securely absorbed.

That is, when a weak external shock which does not cause the first shock absorbing member 16 to be elastically deformed is applied to the wristwatch case 1, the second shock absorbing members 17 change in volume in response to the weak shock force and absorb the shock to escape it. When a strong external shock which causes the first shock absorbing member 16 to be elastically deformed is applied to the wristwatch case 1, at first the second shock absorbing members 17 change in volume to absorb a part of the strong shock and to escape it, and then the remainder of the strong shock which has not been absorbed by the second shock absorbing members 17 can be absorbed by the elastic deformation of the first shock absorbing member 16. Thus, whether the wristwatch case 1 is applied with the strong external shock or the weak external shock, the external shock is securely absorbed. Therefore, the timepiece module 4 within the wristwatch case 1 and the electronic parts 4*b* such as the display panel 13 installed in the timepiece module 4 are protected securely and well.

In the case that the first and second shock absorbing members 16 and 17 are combined and used, the first shock absorbing member 16 together with the second shock absorbing members 17 are elastically deformed by getting a shock force and damp it, as shown in FIG. 7C, the damping vibration of the first shock absorbing member 16 is suppressed by the second shock absorbing members 17 during the first shock absorbing member 16 damps the shock force, and the first shock absorbing member 16 returns to its original state with its damping vibration being relieved during the first shock absorbing member 16 performs its damping vibration. Therefore, the second shock absorbing members 17 relief a bad influence of the damping vibration of the first shock absorbing member 16 to the timepiece module 4, so that the timepiece module 4 and the electronic parts 4*b* such as the display panel 13 installed in the timepiece module 4 are protected well.

In this case, in this shock damping structure of the wristwatch, the thickness of each of the first shock absorbing member 16 and the second shock absorbing members 17 disposed alternately with each other in association with the outer peripheral surface of the timepiece module 4 can be formed as thin as about 1.5 mm. This makes the overall thickness of the damping member 5 which protects the timepiece module 4 being small, thereby preventing the wristwatch case 1 from increasing in size and hence downsizing the whole of the wristwatch.

Further, in this shock damping structure of the wristwatch, the holding member 15 is disposed between the inner peripheral surface of the wristwatch case 1 and the outer peripheral surface of the timepiece module 4, and the side leg portions 16*b* of the first shock absorbing member 16 and the side leg portions 17*b* of the second shock absorbing members 17 are arranged alternately on the outer surface of the holding member 15. Thus, when the first and second shock absorbing members 16 and 17 damp an external shock, the whole of the holding member 15 receives the shock to prevent the shock from being concentrated on one part of the timepiece module 4. This also makes the timepiece module 4 and the electronic parts 4*b* such as the display panel 13 installed in the timepiece module 4 are protected well.

In this case, the bending portions 16*c* of the first shock absorbing member 16, each bending portion 16*c* being bend inward in the radial direction of the holding member from the upper end of each side leg portion 16*b*, are equidistantly arranged on the ring-shaped upper surface portion 15*a* of the holding member 15 in its peripheral direction, and the bending portions 17*a* of the second shock absorbing members 17 extending in the radial direction on upper surface of the ring-shaped upper surface portion 15*a* of the holding member 15 are disposed in the cut-out portions 16*e* provided in the auxiliary damping portions 16*d* between the bending portions 16*c* of the first shock absorbing member 16. Thus, when a shock is applied on the upper surface side of the wristwatch case 1, the shock is securely and well damped by the upper surface portion 16*a* of the first shock absorbing member 16 and the upper piece portions 17*a* of the second shock absorbing members 17.

Further, the side leg portions 16*b* of the first shock absorbing member 16 are disposed at predetermined positions on the outer peripheral surface of the cylindrical outer peripheral surface portion 15*b* of the holding member 15, and the side leg portions 17*b* of the second shock absorbing members 17 are disposed at positions excluding the predetermined positions at which the side leg portions 16*b* of the first shock absorbing member 16 are disposed on the outer side surface of the cylindrical outer peripheral surface portion 15*b* of the holding member 15 so that the side leg portions 16*b* of the first shock absorbing member 16 and the side leg portions 17*b* of the second shock absorbing members 17 are arranged side by side. Thus, when a shock is applied on the wristwatch case 1 in its side direction, the shock is securely and well damped by the side leg portions 16*b* of the first shock absorbing member 16 and the side leg portions 17*b* of the second shock absorbing member 17.

In this case, each of the second shock absorbing members 17 is formed to have a larger thickness than that of the first shock absorbing member 16 and is in contact with the inner surface of the wristwatch case 1. Thus, when an external shock is applied on the wristwatch case 1, the shock is received by the second shock absorbing members 17 earlier than the first shock absorbing member 16, and the second shock absorbing members 17 absorb and escape the shock.

Further, the corrugated thin auxiliary damping portions 16*d* are formed in the upper surface portion 16*a* of the first shock absorbing member 16 and the whole thickness of each auxiliary damping portion 16*d* is substantially equal to that of each of the upper piece portions 17*a* of the second shock absorbing members 17. Thus, when a shock is applied on the upper surface side of the wristwatch case 1, the shock force is applied simultaneously on the second shock absorbing members 17 and the auxiliary damping portions 16*d* so that the auxiliary damping portions 16*d* are deformed elastically while the second shock absorbing members 17 change in volume.

That is, since each auxiliary damping portion 16*d* is formed as thin corrugated shape in the upper surface portion 16*a* of the first shock absorbing member 16, the elastic force of each auxiliary damping portion 16*d* is smaller than the whole elastic force of the upper surface portion 16*a* so that each auxiliary damping portion 16*d* can be easily deformed elastically than the whole of the upper surface portion 16*a*. Therefore, when a shock force is applied on the upper surface portion 16*a* of the first shock absorbing member 16, the corrugated auxiliary damping portions 16*d* together with the upper piece portions 17*a* of the second shock absorbing members 17 can be deformed elastically.

After that, the whole of the upper surface portion 16*a* of the first shock absorbing member 16 is deformed elastically. Thus, even when a strong shock is applied on the upper surface side of the wristwatch case 1, the strong shock is damped securely and well by the upper piece portions 17*a* of the second shock absorbing members 17, the auxiliary damping portions 16*d* provided in the upper surface portion 16*a* of the first shock absorbing member 16, and the upper surface portion 16*a* of the first shock absorbing member 16 in this order.

Further, the auxiliary damping protruding portions 21 for separating the outer surface of the first shock absorbing member 16 from the inner peripheral surface of the wristwatch case 1 are formed on the first shock absorbing member 16 to make each auxiliary damping protruding portion 21 have a height equal to that of the outer surface of each second shock absorbing member 17. Therefore, when a shock is applied on the side surface side of the wristwatch case 1, the shock force is simultaneously applied on the side leg portions 17*b* of the second shock absorbing members 17 and the auxiliary damping protruding portions 21 of the side leg portions 16*b* of the first shock absorbing member 16 so that the auxiliary damping protruding portions 21 can be elastically deformed while the second shock absorbing members 17 change in volume.

That is, since each auxiliary damping protruding portion 21 the width of which is thin in the circumferential direction is provided along the upper and lower directions on each side leg portion 16*b* of the first shock absorbing member 16, the resiliency of each auxiliary damping protruding portion 21 is smaller than that of the whole of each side leg portion 16*b* and each auxiliary damping protruding portion 21 is easily deformed elastically than the whole of each side leg portion 16*b*.

Thus, when a shock force is applied on each side leg portion 16*b* of the first shock absorbing member 16, the auxiliary damping protruding portion 21 being small in its width together with the side leg portion 17*b* of the second shock absorbing member 17 is elastically deformed and then the whole of the side leg portion 16*b*. That is, the shock applied on the side surface side of the wristwatch case 1 is damped securely and well by the side leg portions 17*b* of the second shock absorbing members 17, the auxiliary damping protruding portions 21 provided on the side leg portions 16*b* of the first shock absorbing member 16, and the side leg portions 16*b* of the first shock absorbing member 16 in this order.

As described above and shown in FIGS. 1-7C, in the shock damping structure for an electronic device according to this embodiment, the damping member (5) provided between the device case (1) and the module (4) encased within the device case (1) damps the external shock applied on the device case by the shock absorbing operation of the damping member (5). And, the damping member (5) comprises: the holding member (15) having the upper surface portion (15*a*) and the outer peripheral surface portion (15*b*), and disposed between the inner peripheral surface of the device case (1) and the outer peripheral surface of the module (4); the first shock absorbing member (16) disposed to cover the predetermined part of the upper surface portion (15*a*) and outer peripheral surface portion (15*b*) of the holding member (15), deformed elastically when the external shock is applied on the device case (1), and absorbing the shock elastically; and the second shock absorbing member (17) disposed to cover the other part of the upper and outer peripheral surface portions of the holding member (15), the other part excluding the predetermined part, getting the external shock earlier than the first shock absorbing member (16) when the external shock is applied on the device case (1), changing its volume in accordance with the shock force, and absorbing and escaping the external shock.

In this case, as described above and as shown in FIGS. 1-7C, the first shock absorbing member (16) includes a plurality of side leg portions (16*b*) spaced at predetermined intervals to cover a part of the outer peripheral surface portion (15*b*) of the holding member (15), and a plurality of second shock absorbing members (17) is provided and includes a plurality of side leg portions (17*b*) arranged alternately with the plurality of side leg portions (16*b*) of the first shock absorbing member (16) on the outer peripheral surface portion (15*b*) of the holding member (15).

As described above and shown in FIGS. 1-7C, each second shock absorbing member (17) is formed to be thicker than the first shock absorbing member (16) and in contact with the inner peripheral surface of the device case (1).

As described above and shown in FIGS. 1-7C, the upper surface portion (16*a*) of the first shock absorbing member (16) includes the thin corrugated auxiliary damping portion (16*d*) whose whole thickness is substantially equal to that of the second shock absorbing member (17).

As described above and shown in FIGS. 1-7C, the auxiliary damping protruding portion (21) for separating the side leg portion (16*b*) of the first shock absorbing member (16) from the inner surface of the device case (1) is formed on the side leg portion (16*b*), the auxiliary damping protruding portion (21) having the height substantially equal to the height of the outer surface of the second shock absorbing member (17).

As described above and shown in FIGS. 1-7C, in the shock damping structure for an electronic device according to another embodiment, the damping member (5) is provided between the device case (1) and the module (4) encased within the device case (1) damps the external shock applied on the device case (1) by the shock absorbing operation of the damping member (5). The damping member (5) comprises: the first shock absorbing member (16) disposed between the inner peripheral surface of the device case (1) and the outer peripheral surface of the module, deformed elastically when the external shock is applied on the device case (1), and absorbing elastically the shock; and the second shock absorbing member (17) disposed at the part between the inner peripheral surface of the device case (1) and the outer peripheral surface of the module, the part excluding the part in which the first shock absorbing member is disposed, getting the external shock earlier than the first shock absorbing member (16) when the external shock is applied on the device case (1), changing its volume in accordance with the shock force, and absorbing and escaping the external shock.

In this case, as described above and as shown in FIGS. 1-7C, the first shock absorbing member (16) includes a plurality of bending portions (16*c*), each of which is bent radially inward of the holding member from the upper end of each side leg portion (16*b*) thereof, and a plurality of second shock absorbing members (17) are provided to include a plurality of bending portions (17*a*), each of which is the upper end of each side leg portion (17*b*) thereof and bent radially inward of the holding member, these bending portions (17*a*) being disposed alternately with the bending portions (16*c*) of the first shock absorbing member (16) on the upper surface of the holding member (16).

As described above and shown in FIGS. 1-7C, the first shock absorbing member (16) includes a plurality of side leg portions (16*b*) at the predetermined spaced positions on the outer peripheral surface portion (15*b*) of the holding member (15), and a plurality of second shock absorbing members (17) are provided to include the bending portions (17*b*) arranged alternately with the plurality of side leg portions (16*b*) of the first shock absorbing member.

As described above and shown in FIGS. 1-7C, the electronic device according to one embodiment comprises the device case (1), the module (the timepiece module 4) encased within the device case (1) and provided with the electronic parts (4*b* such as the display panel 13), and the damping member (5) provided between the device case (1) and the module and damping the external shock applied on the device case. The damping member (5) includes: the holding member (15) disposed between the inner peripheral surface of the device case (1) and the outer peripheral surface of the module; the first shock absorbing member (16) disposed at the predetermined position on the holding member (15), deformed elastically when the external shock is applied on the device case (1), and elastically absorbing the shock; and the second shock absorbing member (17) disposed side by side with the first shock absorbing member (16) on the holding member, getting the external shock earlier than the first shock absorbing member (16) when the external shock is applied on the device case (1), changing its volume in accordance with the shock force, and absorbing and escaping the external shock.

As described above and shown in FIGS. 1-7C, the damping member (5) according to one embodiment comprises the damping member body (5A) provided between the device case (1) and the module (4) encased within the device case (1) and damping the external shock applied on the device case. The damping member body (5A) includes: the holding member (15) having the upper surface and the side surface and disposed between the inner peripheral surface of the device case (1) and the outer peripheral surface of the module (4); the first shock absorbing member (16) disposed to cover the predetermined part of the upper and side surfaces of the holding member (15), deformed elastically when the external shock is applied on the device case (1), and elastically absorbing the external shock; and the second shock absorbing member (17) disposed to cover the other part of the holding member (15), the other part excluding the predetermined part, getting the external shock earlier than the first shock absorbing member (16) when the external shock is applied on the device case (1), changing its volume in accordance with the shock force, and absorbing and escaping the external shock.

Although, in the above described embodiments, the damping member 5 disposed between the inner surface of the wristwatch case 1 and the outer surface of the housing 12 of the timepiece module 4 includes the holding member 15 disposed on the outer surface of the housing 12, the holding member 15 is not necessarily provided on the outer surface of the housing 12. For example, the first and second shock absorbing members 16 and 17 may be directly disposed on the outer surface of the housing 12.

Although, in the above described embodiments and modifications thereof, the auxiliary damping portion 16*d* is provided on the upper surface portion 16*a* of the first shock absorbing member 16 and the auxiliary damping protruding portion 21 is provided on the side leg portion 16*b* of the first shock absorbing member 16*e*, the auxiliary damping portion 16*d* may be provided on the side leg portion 16*b* of the first shock absorbing member 16*e* and the auxiliary damping protruding portion 21 may be provided on the upper surface portion 16*a* of the first shock absorbing member 16. Further, both of the auxiliary damping portion 16*d* and the auxiliary damping protruding portion 21 may be provided on each of the upper surface portion 16*a* and auxiliary damping protruding portion 21 of the first shock absorbing member 16.

Although, in the above described embodiments and modifications thereof, the present invention is applied to the digital-type wristwatch equipped with the display panel 13, the present invention may be applicable to various time pieces including for example an analog-type wristwatch equipped with hands, a travel watch, an alarm clock, a table clock, and a wall clock, as well as various electronic devices including for example a mobile phone, an electronic dictionary, a portable information terminal (PDA: personal digital assistant), and a personal computer, etc.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A shock damping structure for a wristwatch, in which a damping member provided between a wristwatch case and a wristwatch module encased within the wristwatch case damps an external shock applied on the wristwatch case by a shock absorbing operation of the damping member, the damping member comprising:

a holding member having a ring-shaped upper surface portion and a cylindrical portion, and disposed between an inner peripheral surface of the wristwatch case and an outer peripheral surface of the wristwatch module;

a first shock absorbing member disposed to cover a predetermined part of an upper surface of the upper surface portion and outer peripheral surface of the cylindrical portion of the holding member, deformed elastically when an external shock is applied on the wristwatch case, and absorbing the shock elastically; and a second shock absorbing member disposed to cover another part of the upper and outer peripheral surface portions of the holding member, the other part excluding the predetermined part, getting the external shock earlier than the first shock absorbing member when the external shock is applied on the wristwatch case, changing its volume in accordance with a shock force of the external shock, and absorbing the external shock, wherein the first shock absorbing member includes an upper surface portion and side leg portions formed integrally with each other to extend along the upper surface of the upper surface portion and outer peripheral surface of the cylindrical portion of the holding member, and further including cut-out portions at positions corresponding to 3, 6, 9, and 12 o'clock positions of the wristwatch case, and wherein the second shock absorbing member is made of a gel-like material whose main component is silicone and includes bending portions and side leg portions formed integrally with the bending portions, the bending portions and side leg portions being arranged at the cut-out portions of the first shock absorbing member to extend along the upper surface of the upper surface portion and outer peripheral surface of the cylindrical portion of the holding member.

2. The shock damping structure of claim 1, wherein each second shock absorbing member is formed to be thicker than the first shock absorbing member and in contact with the inner peripheral surface of the wristwatch case.

3. The shock damping structure of claim 1, wherein the upper surface portion of the first shock absorbing member includes a thin corrugated auxiliary damping portion whose whole thickness is substantially equal to that of the bending portion of the second shock absorbing member.

4. The shock damping structure of claim 1, wherein an auxiliary damping protruding portion is formed on the side leg portion of the first shock absorbing member to contact the inner surface of the wristwatch case and to separate the side leg portion of the first shock absorbing member from the inner surface of the wristwatch case, and a height of the auxiliary damping protruding portion from the side leg portion is substantially equal to a height of the side leg portion of the second shock absorbing member between an outer surface thereof and a lower surface thereof.

5. A shock damping structure for an a wristwatch, in which a damping member provided between a wristwatch case and a wristwatch module encased within the wristwatch case damps an external shock applied on the wristwatch case by a shock absorbing operation of the damping member, the damping member comprising:

a first shock absorbing member disposed at a part between an inner peripheral surface of the wristwatch case and an outer peripheral surface of the wristwatch module, deformed elastically when the external shock is applied on the wristwatch case, and absorbing elastically the shock; and a second shock absorbing member disposed at another part between the inner peripheral surface of the wristwatch case and the outer peripheral surface of the wristwatch module, the other part excluding the first shock absorbing member, getting the external shock earlier than the first shock absorbing member when the external shock is applied on the wristwatch case, changing its volume in accordance with a shock force of the external shock, and absorbing the external shock, wherein the first shock absorbing member includes an upper surface portion and side leg portions formed integrally with each other to extend along the inner peripheral surface of the wristwatch case and the outer peripheral surface of the wristwatch module between them, and further including cut-out portions at positions corresponding to 3, 6, 9, and 12 o'clock positions of the wristwatch case, and wherein the second shock absorbing member is made of a gel-like material whose main component is silicone and includes bending portions and side leg portions formed integrally with the bending portions, the bending portions and side leg portions being arranged at the cut-out portions of the first shock absorbing member to extend along the inner peripheral surface of the wristwatch case and the outer peripheral surface of the wristwatch module between them.

6. A wristwatch, comprising a wristwatch case, a wristwatch module encased within the wristwatch case and provided with electronic parts, and a damping member provided between the wristwatch case and the wristwatch module and damping an external shock applied on the wristwatch case, the damping member including:

a holding member having a ring-shaped upper surface portion and cylindrical portion, and disposed between an inner peripheral surface of the wristwatch case and an outer peripheral surface of the wristwatch module;

a first shock absorbing member disposed at a predetermined part on the holding member, deformed elastically when the external shock is applied on the wristwatch case, and elastically absorbing the shock; and a second shock absorbing member disposed side by side with the first shock absorbing member on the holding member, getting the external shock earlier than the first shock absorbing member when the external shock is applied on the wristwatch case, changing its volume in accordance with a shock force of the external shock, and absorbing the external shock, wherein the first shock absorbing member includes an upper surface portion and side leg portions formed integrally with each other to extend along the upper surface of the upper surface portion and outer peripheral surface of the cylindrical portion of the holding member, and further including cut-out portions at positions corresponding to 3, 6, 9, and 12 o'clock positions of the wristwatch case, and wherein the second shock absorbing member is made of a gel-like material whose main component is silicone and includes bending portions and side leg portions formed integrally with the bending portions, the bending portions and side leg portions being arranged at the cut-out portions of the first shock absorbing member to extend along the upper surface of the upper surface portion and outer peripheral surface of the cylindrical portion of the holding member.

7. A damping member comprising a damping member body provided between a wristwatch case and a wristwatch module encased within the wristwatch case and damping an external shock applied on the wristwatch case, the damping member body including:

a holding member having an upper surface and a side surface and disposed between an inner peripheral surface of the wristwatch case and an outer peripheral surface of the wristwatch module;

a first shock absorbing member disposed to cover a predetermined part of the upper and side surfaces of the holding member, deformed elastically when the external shock is applied on the wristwatch case, and elastically absorbing the external shock; and a second shock absorbing member disposed to cover another part of the upper and side surfaces of the holding member, the other part excluding the predetermined part, getting the external shock earlier than the first shock absorbing member when the external shock is applied on the wristwatch case, changing its volume in accordance with a shock force of the external shock, and absorbing the external shock, wherein the first shock absorbing member includes an upper surface portion and side leg portions formed integrally with each other to extend along the upper surface and side surface of the holding member, and further including cut-out portions at positions corresponding to 3, 6, 9, and 12 o'clock positions of the wristwatch case, and wherein the second shock absorbing member is made of a gel-like material whose main component is silicone and includes bending portions and side leg portions formed integrally with the bending portions, the bending portions and side leg portions being arranged at the cut-out portions of the first shock absorbing member to extend along the upper surface and side surface of the holding member.

* * * * *